United States Patent [19]

Kubo

[11] Patent Number: 4,847,482

[45] Date of Patent: Jul. 11, 1989

[54] X-RAY IMAGE INTENSIFIER WITH COLUMNAR CRYSTAL PHOSPHOR LAYER

[75] Inventor: Hiroshi Kubo, Ootawara, Japan

[73] Assignee: Kabushiki Kaisha Toshiba, Kawasaki, Japan

[21] Appl. No.: 167,244

[22] Filed: Mar. 11, 1988

[30] Foreign Application Priority Data

Mar. 13, 1987 [JP] Japan ..... 62-56740

[51] Int. Cl.[4] ..... H01J 31/50

[52] U.S. Cl. ..... 250/213 VT; 313/525

[58] Field of Search ..... 250/213 VT, 213 R, 483.1, 250/486.1; 313/525, 527, 542, 523

[56] References Cited

U.S. PATENT DOCUMENTS

| | | | |
|---|---|---|---|
| 2,743,195 | 4/1956 | Longini | 250/213 VT |
| 3,716,713 | 2/1973 | Levin | 250/367 |
| 4,740,683 | 4/1988 | Noji et al. | 250/213 VT |

FOREIGN PATENT DOCUMENTS

| | | |
|---|---|---|
| 0042149 | 6/1981 | European Pat. Off. . |
| 2467481 | 4/1981 | France . |
| 53-102663 | 9/1978 | Japan . |
| 53-102664 | 9/1978 | Japan . |
| 59-207551 | 11/1984 | Japan . |

*Primary Examiner*—David C. Nelms
*Assistant Examiner*—Eric F. Chatmon
*Attorney, Agent, or Firm*—Cushman, Darby & Cushman

[57] ABSTRACT

An X-ray image intensifier comprises a vacuum envelope having an input window, through which X-rays are incident on said vacuum envelope, an input fluorescent screen for converting the X-rays into light rays, a photoelectric layer for converting the light rays into electrons, an anode and a focusing electrode forming an electron lens for accelerating and focusing the electrons and an output fluorescent screen for converting the electrons accelerated and focused by the electron lens into a visible image. The input fluorescent screen includes a first phosphor layer having a first density and a second phosphor layer having a second density higher than the first density. The second phosphor layer is placed on that side of the first phosphor layer which faces the photoelectric layer. The thickness of the second phosphor layer is greater at the peripheral areas than the central part of the input fluorescent screen.

8 Claims, 5 Drawing Sheets

X-RAY IMAGE INTENSIFIER WITH COLUMNAR CRYSTAL PHOSPHOR LAYER

BACKGROUND OF THE INVENTION

This invention relates to an X-ray image intensifier for converting an X-ray image into a visible image.

X-ray image intensifiers are being used widely in X-ray image pickup apparatus for medical use and industrial televisions for non-destructive inspection.

This type of X-ray image intensifier has a vacuum envelope. This vacuum envelope is provided with an input window, through which X-rays are incident on the vacuum envelope. In the vacuum envelope, a curved substrate is placed facing the input window. An input fluorescent screen and a photoelectric layer are deposited in that order on the side of the substrate opposite to the input window. An anode and an output fluorescent screen are provided on the output side of the vacuum envelope. A focusing electrode is provided on the internal peripheral wall of the vacuum envelope.

The X-rays emitted from an X-ray tube penetrate the test object, pass through the input window and the substrate and are converted into light rays by the input fluorescent screen. The light rays are converted by the photoelectric layer into electrons. The electrons are accelerated and focused by an electron lens formed by the focusing electrode and the anode. Then, the electrons are converted by the output fluorescent screen into a visible image.

The visible image is picked up by using a TV camera, or a cinecamera or a spot camera to produce a permanent image, and the resultant image is then used for medical diagnosis, for example.

Among the input fluorescent screens used for X-ray image intensifiers lately is an input fluorescent screen which is far greater in thickness than the prior input fluorescent screens.

The X-rays absorbed by an input fluorescent screen with thickness T can be expressed as $$1-\bar{e}^{\phi T}$$

where $\phi$ is the X-ray absorption coefficient. FIG. 1 shows the relation between the thickness of the input fluorescent screen and the X-ray absorption rate. In the figure, the material of the input fluorescent screen is cesium iodide (CsI) and an energy of X-rays is 60 keV. The X-ray absorption rate increases as the thickness increases. By increasing the X-ray absorption rate in this way, the X-rays can be utilized more effectively, making it possible to reduce the radiation dose and improve the quality of an image.

If uniform X-rays are irradiated to an X-ray image intensifier and an output image is observed, it sometimes causes the central portion of the output image to be light and the brightness to be decreased toward the peripheral areas. The reason is that the peripheral areas of the image is enlarged more than the central part by what is called an electron lens of the X-ray image intensifier. With such an output brightness distribution, it is impossible to make an effective use of the whole dynamic range after an image is picked up. That is to say, a wide usable range of an output image cannot be secured.

As one of the methods for making the output brightness distribution as flat as possible, there is a known method that increases the thickness of the input fluorescent screen from the central part progressively toward the peripheral areas, as disclosed in Japanese Patent Disclosure No. 78-102663. With this method, the input fluorescent screen absorbs more X-rays and emits more light at the peripheral areas than the central part. Therefore, the brightness of the peripheral areas is increased on the output side and the output brightness distribution can thereby be made close to a flat distribution.

This means cannot be applied to an X-ray image intensifier incorporating a thickness-increased input fluorescent screen described above. The reason is described in the following. First, let us consider using a model how much of the light emanating from the input fluorescent screen reaches the photoelectric layer when a certain quantity of X-rays are falls on the input fluorescent screen. The model is shown in FIG. 3. In an input fluorescent screen with thickness T, the quantity of conversion of X-rays into light at a micro part dt at the depth t is proportional to the dose of X-rays at the position t. Since the distance from the micro part dt to the photoelectric layer is T−t, if the attenuation coefficient of the light in the input fluorescent screen is denoted by $\beta$, the quantity of light that reaches the photoelectric layer of all the light produced by conversion at the micro part dt is:

$$\alpha e^{-\alpha T} \cdot e^{-\beta(T-t)} dt$$

Therefore, by integrating the above equation, the quantity of light reaching the photoelectric layer of all the light to which the X-rays are converted over the whole input fluorescent Screen is given as follows.

$$\alpha \int_{o}^{T} e^{-\alpha T} \cdot e^{-\beta(T-t)} dt$$

where $\alpha$ denotes the X-ray absorption coefficient. This definite integral has a peak value. Input fluorescent screens of various thicknesses were produced and the quantity of light of the photoelectric layers was measured. The light quantity of the photoelectric layer showed a peak (maximal) value at a certain thickness. The experimental results are shown in Fig, 4. The data used for the curve were measured values of the brightness of independent input fluorescent screen films composed of CsI. The energy of the X-rays in this experiment was 60 keV.

If, in order to make good use of the X-rays, a thickness value at which a peak value of light quantity is obtained is used for the thickness of the central part of an input fluorescent screen, the earlier-described method of correcting the output brightness distribution cannot be applied. To be more specific, evenif the peripheral areas of the input fluorescent screen is increased in thickness than the central part, the brightness of the peripheral areas is lower. As a result, the graph of output brightness distribution assumes a sharp-peaked normal distribution curve. If the thickness is increased further, the resolution is reduced due to the dispersion of the light. Therefore, a thickness corresponding to a peak value of the quantity of light produced is considered as the maximum thickness that can be applied for practical use. Hence, when such a thick film type input fluorescent screen is made, there arises a problem that the output brightness distribution cannot be corrected effectively and this problem must be solved.

Another problem will be described in the following. If the thickness is varied over the whole area of the screen, the X-ray absorption coefficient changes with the quality of X-ray at different positions of the screen. For this reason, even if the output brightness distribution is flat with a given quality of X-ray, the distribution is not flat with another quality of X-ray.

As the other way of making the output brightness distribution flat, there is a method of forming a film, the light transmittance of which is varied, over the whole area of the film on the surface of the input fluorescent screen. More specifically, this method uses a reduced light transmittance for the part of the film at the center of the input fluorescent screen thereby flattening the output brightness distribution. However, this method s accompanied by a problem that some processes have to be added for vapor-depositing a film having a light transmittance varied in a symmetric form. Since there is a symmetric variation in the light transmittance of the film between the input fluorescent screen and the photoelectric layer, the conditions for forming the photoelectric layer are not uniform. In addition, there is a possibility that a symmetric variation occurs in the variation with time.

SUMMARY OF THE INVENTION

The object of this invention is to provide an X-ray image intensifier capable of flattning the output brightness distribution even when a thick film type input fluorescent screen is used and reducing a variation in the output brightness distribution due to changes in the quality of X-ray.

According to an aspect of the present invention, there is provided an X-ray image intensifier which comprises a vacuum envelope having an input window, through which X-rays are incident on said vacuum envelope; an input fluorescent screen for converting the incident X-rays into light rays, said input fluorescent screen having a first phosphor layer with a first density and a second phosphor layer with a second density higher than the first density, the first phosphor layer being placed on that side of the second phosphor layer which faces said input window, the thickness of the second phosphor layer being greater at peripheral areas than the central part of the input fluorescent screen; a photoelectric layer for converting the light rays into electrons; electrode means forming an electron lens for accelerating and focusing the electrons; and an output fluorescent screen for converting the electrons accelerated and focused by the electron lens into a visible image.

DETAILED DESCRIPTION OF THE PREFERRED EMBODIMENT

Figure 1:
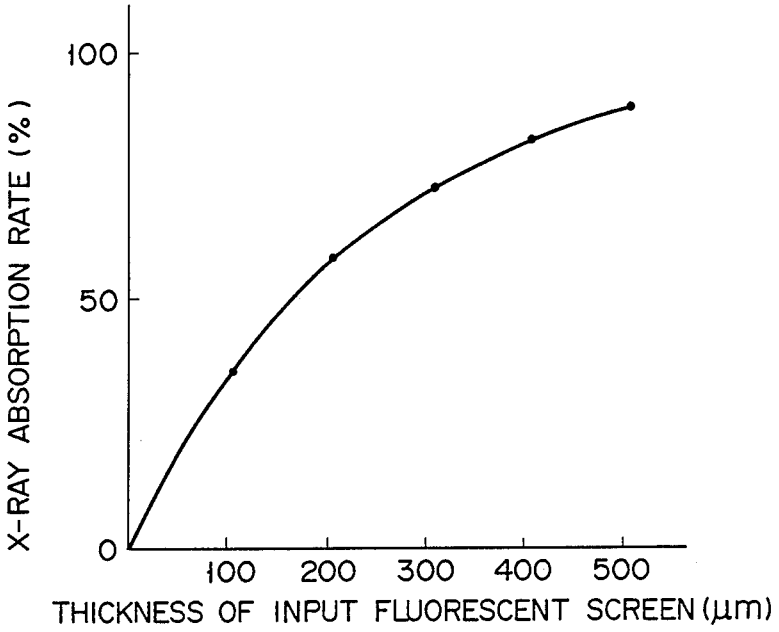
FIG. 1 is a diagram representing the relation between the thickness of an input fluorescent screen and the X-ray absorption rate.
Figure 2:
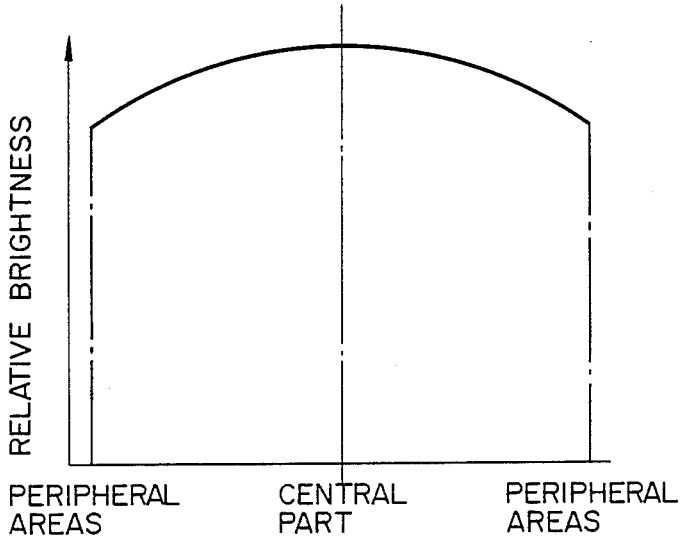
FIG. 2 is a diagram showing an output brightness distribution.
Figure 3:
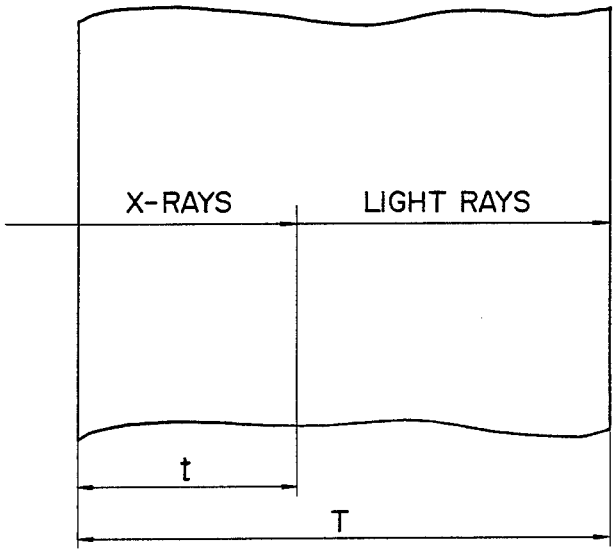
FIG. 3 is an explanatory drawing showing the way in which the light produced in the input fluorescent screen attnuates.
Figure 4:
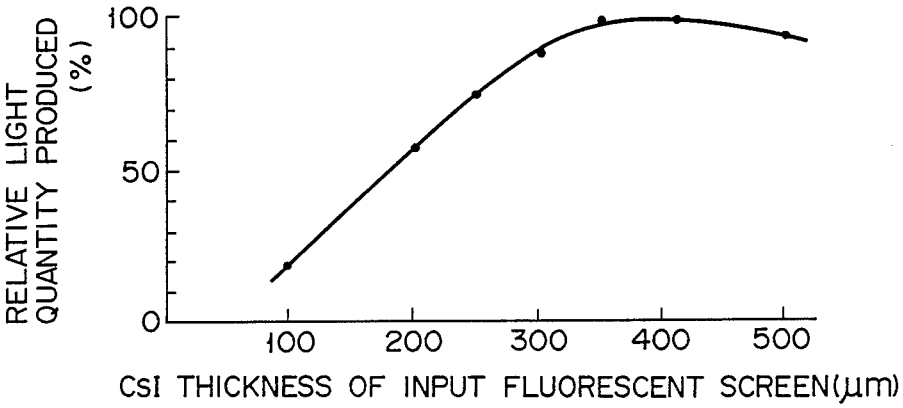
FIG. 4 is a diagram showing the relation between the thickness of input fluorescent screen and the relative light quantity produced.
Figure 5:
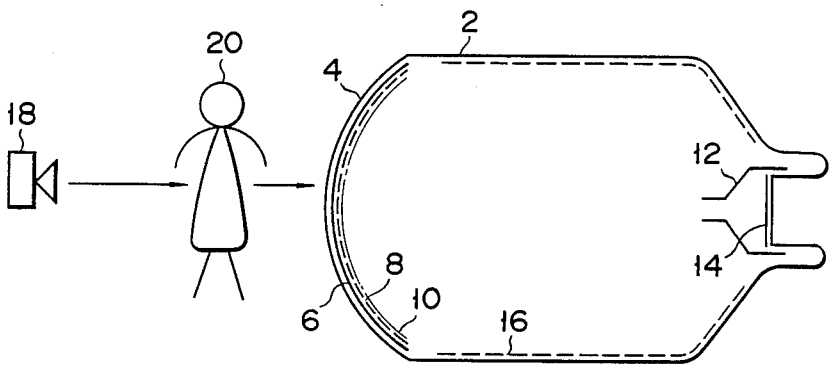
FIG. 5 is a diagram showing an X-ray image intensifier according to this invention.

Referring to FIG. 5, the numeral 2 indicates a vacuum envelope of an X-ray image intensifier. This vacuum envelope 2 has input window 4, through which incident X-rays are cast upon vacuum envelope 2. In vacuum envelope 2, curved substrate 6 is placed where it faces input window 4. Input fluorescent screen 8 and photoelectric layer 10 are deposited in the above mentioned order on the side of substrate 6, opposite to input window 4. Photoelectric layer 10 converts the X-rays input through input window 4, into light rays. Photoelectric layer 10 converts the light rays emanating from input fluorescent screen 8, into electrons. Anode 12 and output fluorescent screen 14 are provided on the output side of vacuum envelope 2. Focusing electrode 16 is provided along the internal peripheral wall of vacuum envelope 2. Anode 12 and focusing electrode 16, together form an electron lens. The electron lens accelerates and focuses the electrons emitted from photoelectric layer 10. Output fluorescent screen 14 converts the electrons of which were accelerated and focused by the electron lens, which is composed of anode 12 and focusing electrode 16, into a visible image.

The X-rays emitted from X-ray tube 18 penetrate the test object 20, pass through the input window 4 and the substrate 6 and are then converted into light rays by the input flourescent screen 8. The light rays are converted into electrons by photoelectric layer 10. The electrons are accelerated and focused by an electron lens composed of anode 12 and the focusing electrode 16. Then, the electrons are converted into a visible image by the output fluorescent screen 14.

The visible image is recorded by means of a TV camera, a cine camera or a spot camera, and the image is then used as a permanent record for medical diagnosis, for example.

Figure 6:
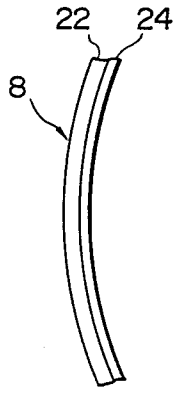
FIG. 6 is a sectional view of the input fluorescent screen used for the X-ray image intensifier of FIG. 5.

As shown in FIG. 6, input fluorescent screen 8 is composed of first phosphor layer 22 having a specified density and second phosphor layer 24 having a density higher than that of first phosphor layer 22. Second phosphor layer 24 is provided on the output side of first phosphor layer 22, namely, on the side of first phosphor layer 22 which is opposite to the side which contacts substrate 6.

Figure 7:
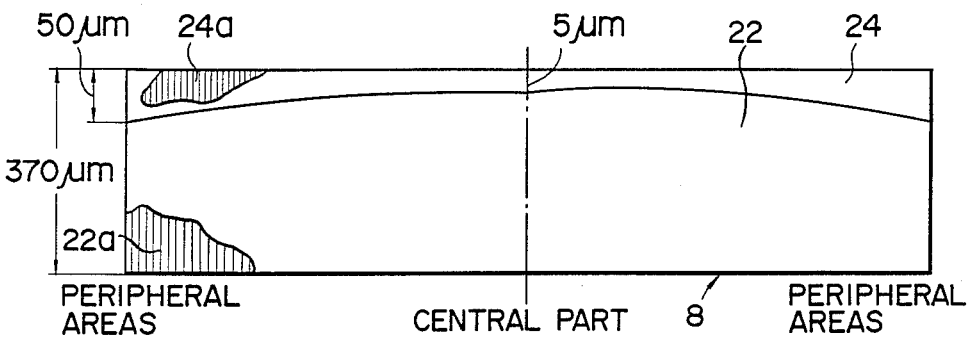
FIG. 7 is a sectional view showing a distribution of a high density layer and a low density layer that constitute the input fluorescent screen of FIG. 6.

Referring to FIG. 7, first phosphor layer 22 and second phosphor layer 24 of input fluorescent screen 8 consist respectively of long and narrow columnar crystals **22*a* and 24*a* formed in a direction perpendicular to input fluorescent screen 8. Columnar crystals 22*a* and 24*a* are activated cesium iodides (CsI) such as sodium-activated cesium iodide. Columnar crystals 22*a* and 24*a* serve to control the density of input fluorescent screen 8**.

The thickness of second phosphor layer 24 is greater at the peripheral areas than in the central part of input fluorescent screen 8. The thickness of first phosphor layer 22 is thinner in the peripheral areas of input fluorescent screen 8 than in the central part. Thus, the entire input fluorescent screen 8 has a generally uniform thickness extending from its central part toward the peripheral areas. For example, the thickness of second phosphor layer 24 is 5 μm at the central part and 50 μm in the peripheral areas, first phosphor layer 22 is 365 μm at the central part and 220 μm in the peripheral areas and the thickness of the whole input fluorescent screen 8 is 370 μm.

Figure 8:
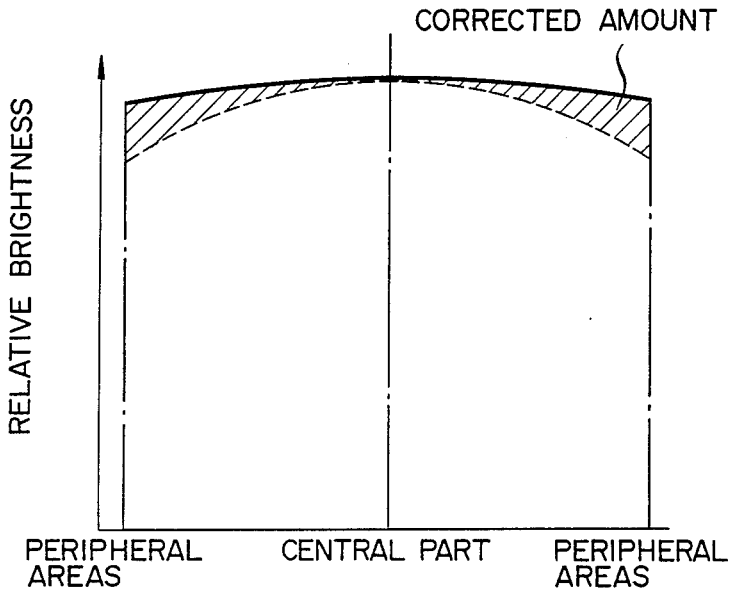
FIG. 8 is a diagram to explain the correction of output brightness distribution in the X-ray image intensifier according to this invention.

If the above construction is applied to an input fluorescent screen, even when input fluorescent screen 8 is a type having an increased thickness, the resolution and the photoelectric sensitivity at the peripheral areas of input fluorescent screen 8 can still be improved. Therefore, the output brightness distribution can be corrected to be flat as indicated in FIG. 8. At the same time, the changes in the output brightness distribution caused by changes in the quality of X-ray can be reduced.

The reason why such advantages can be obtained will now be described in the following.

Normally, the phosphor that constitutes the fluorescent screen absorbs X-rays and emits light rays. The emitted light rays radiate in all directions. The diffusion of these light rays which traveling toward the input fluorescent screen, reduces the image resolution. The general practice used in preventing this light diffusion is to form long and narrow columnar crystals in a direction perpendicular to the fluorescent screen and make the light rays emanating from the phosphor totally reflected or pass through the interstices of the columnar crystals, thereby attenuating the light rays.

In the above case, spaces exist between the columnar crystals.

For this reason, the density of the phosphor is generally about 0.5% lower in the case where the phosphor is filled without leaving any space. The light transmittance, too, is also lower than in the case where the phosphor is filled without leaving any space due to the attenuation of the light described above.

Assuming a phosphor layer having thickness T is provided, the quantity of light reaching the photoelectric layer is expressed roughly as follows:

$$\alpha \int_{o}^{T} e^{-\alpha T} \cdot e^{-\beta(T-t)} dt$$

where $\alpha$ is the X-ray absorption coefficient and $\beta$ is the light absorption coefficient. By calculating this definite integral, we are given:

$$\alpha \frac{1}{\beta - \alpha} \exp(-\beta T)\{\exp(\beta - \alpha)T - 1\}$$

Considering the above result as a function of T, the value of T when the light quantity is at a peak value, is obtained as follows.

$$T = n(\beta/\alpha)/(\beta - \alpha)$$

When the phosphor is made of CsI columnar crystals, that is, the density of the input fluorescent screen is low, the values of $\alpha$ and $\beta$ obtained by an experiment using homogeneous X-rays of 60 keV are as follows: $\alpha = 4.4 \times 10^{-3}$ $\mu m^{-1}$ and $\beta = 1.5 \times 10^{-3}$ $\mu m^{-1}$. These values are of the light of 420 nm, which is the peak value of the CsI emission spectrum. By inserting these values in the above equation, the thickness T=370 μm is achieved in which the light quantity is the greatest.

Therefore, a phosphor layer having a thickness greater than or less than what is represented by the above values, will reduce the light quantity reaching the photoelectric layer and lower the brightness.

When the thickness of the fluorescent screen is put at 370 μm and the fluorescent screen is composed of a low density layer with a thickness of 340 μm consisting of columnar crystals and a high density layer (higher than the lower density layer) with a thickness of 30 μm, since the difference in density between the low and high density layers is less than 1%, there is little difference in the X-ray absorption rate, but a large difference is recognized in the light transmittance. According to the measurement results, $\beta$ is less than $1 \times 10^{-5}$ $\mu m^{-1}$. In a fluorescent screen made up of these low and high density layers, the light quantity that reaches the photoelectric layer can be expressed as:

$$\left( \int_{o}^{T} \alpha e^{-\alpha T} \cdot e^{-\beta 1(T-t)} dt \right) e^{-\beta 2 T2} + \int_{T_1}^{T_1 + T_2} \alpha e^{-\alpha t} \cdot e^{-\beta 2(T2-t)} dt$$

Let us assume that $T_1$, the thickness of the low density layer, is 340 μm; $T_2$, the thickness of the high density layer, is 30 μm; $\alpha$, the X-ray absorption coefficient of the low and high density layers, is $4.4 \times 10^{-3}$ $\mu m^{-1}$; $\beta_1$, the light absorption coefficient of the low density layer, is $1.5 \times 10^{-3}$ $\mu m^{-1}$ and $\beta_2$, the light absorption coefficient of the high density layer, is $1 \times 10^{-5}$ $\mu m^{-1}$. Since $\beta_2$ is a very small value, $e^{-\beta 2\, T_2}$ and $e^{-\beta 2(T2-t)}$ each can be regarded as 1. Therefore, by solving the above integral equation, the light quantity L can be given as follows.

$$L = \alpha \frac{1}{\beta_1 - \alpha} \cdot \exp(-\beta_1 T_1) \cdot \{\exp(\beta_1 - \alpha)T_1 - 1\} - \{\exp(-\alpha T_1) - \exp(-\alpha T_2)\}$$

By constituting the above values into this equation, it is understood that in the fluorescent screen composed of the low and high density layers, the light quantity reaching the photoelectric layer is about 4.5% greater than that in a 370 μm-thick fluorescent screen of low density, consisting entirely of columnar crystals.

Figure 9:
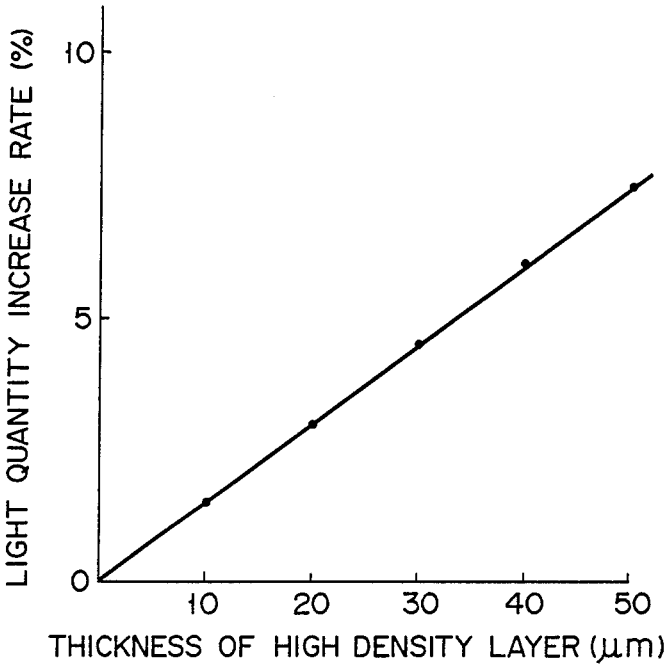
FIG. 9 is a diagram showing the relation between the thickness of the high density layer and the light quantity increase rate.

FIG. 9 shows the values obtained by assuming that the low density layer thickness $T_1$ and the high density layer thickness $T_2$ are as follows: ($T_l$, $T_2$)=(360 μm, 10 μm), (350 μm, 20 μm), (340 μm, 30 μm), (330 μm, 40 μm) and (320 μm, 50 μm).

By forming a fluorescent screen of a low density layer and a high density layer, the light quantity reaching the photoelectric layer can be increased.

If the proportion of the high density layer is increased, the light quantity is further increased. Therefore, for example, if the first phosphor layer thickness $T_1$ is 370 μm and the second phosphor layer thickness $T_2$ is 0 μm at the central part of the input fluorescent screen and the first phosphor layer thickness $T_1$ is 320 μm and the second phosphor layer thickness $T_2$ is 50 μm in the peripheral areas, the brightness of the peripheral areas can be increased about 7.5%.

Next, the brightness when the whole fluorescent screen (370 μm thick) is composed of a phosphor of low density is 0.573, which was obtained by using the equation shown above. The brightness is 0.575 when the low density layer thickness $T_1$ is 340 μm, the high density layer thickness $T_2$ is 30 μm and the high density layer is provided on the X-ray source side. The brightness is 0.600 when the low density layer thickness $T_1$ is 40 μm, the high density layer thickness $T_2$ is 30 μm and the high density layer is provided on the output side. Thus, when the high density layer is provided on the X-ray source side, the brightness can hardly be increased. However, when the high density layer is provided on the output side, the brightness can be improved about 5%.

Meanwhile, the X-ray absorption rate varies with the thickness. Therefore, if the above-described construction is used, the brightness can be improved by varying the thicknesses of the low and high density layers constituting the fluorescent screen from the central part to the peripheral areas without varying the thickness of the whole of the fluorescent screen and therefore, the brightness distribution is not changed by changes in the quality of X-ray.

What is claimed is:

1. An X-ray image intensifier comprising:

a vacuum envelope having an input window, through which incident X-rays are cast upon said vacuum envelope;

an input fluorescent screen disposed to receive said incident X-rays from said input window for converting the incident X-rays into light rays, said input fluorescent screen having a first phosphor layer formed of columnar crystals and having a first density, and a second phosphor layer with a second density which is higher than the first density, the first phosphor layer being located on a side of the second phosphor layer which faces said input window, the thickness of the second phosphor layer being greater in the peripheral areas of said input fluorescent screen than in the central part;

a photoelectric layer, disposed to receive said light rays from said fluorescent screen, for converting the light rays into electrons;

electrode means, disposed to receive said electrons from said photoelectric layer, for forming an electron lens for accelerating and focusing the electrons; and an output fluorescent screen for converting the electrons which were accelerated and focused by said electron lens, into a visible image.

2. The X-ray image intensifier according to claim 1, wherein the thickness of said first phosphor layer is thinner in the peripheral areas of said input fluorescent screen than in the central part.

3. The X-ray image intensifier according to claim 1, wherein said input fluorescent screen has a generally uniform thickness from its central part to its peripheral areas.

4. The X-ray image intensifier according to claim 1, wherein said input fluorescent screen consists of activated cesium iodide.

5. The X-ray image intensifier according to claim 4, wherein said input fluorescent screen consists of sodium-activated cesium iodide.

6. The X-ray image intensifier according to claim 1, wherein said second phosphor layer is also formed of columnar crystals.

7. A fluorescent screen for use in an X-ray image intensifier, adapted to convert X-rays incident on the X-ray image intensifier into light rays, said fluorescent screen comprising:

a first phosphor layer, formed of columnar crystals, and having a first density, said phosphor layer having a ray-input surface and a ray-output surface; and a second phosphor layer formed on the ray-output surface of said first phosphor layer, having a second density higher than the first density, the central part of said second phosphor layer being thinner than the peripheral areas thereof.

8. A screen as in claim 7 wherein said second phosphor layer is also formed of columnar crystals.

* * * * *